US012799888B2

(12) United States Patent
Ono et al.

(10) Patent No.: US 12,799,888 B2
(45) Date of Patent: Nov. 17, 2026

(54) METHOD OF MANUFACTURING OPENING MEMBER, AND PRESSING JIG

(71) Applicant: FUTABA INDUSTRIAL CO., LTD., Aichi (JP)

(72) Inventors: Riku Ono, Aichi (JP); Makoto Suzuki, Aichi (JP); Akira Sakai, Aichi (JP)

(73) Assignee: FUTABA INDUSTRIAL CO., LTD., Aichi (JP)

( * ) Notice: Subject to any disclaimer, the term of this patent is extended or adjusted under 35 U.S.C. 154(b) by 350 days.

(21) Appl. No.: 18/747,783

(22) Filed: Jun. 19, 2024

(65) Prior Publication Data

US 2025/0012212 A1 Jan. 9, 2025

(30) Foreign Application Priority Data

Jul. 7, 2023 (JP) ..... 2023-112347

(51) Int. Cl.
*F01N 13/18* (2010.01)

(52) U.S. Cl.
CPC ..... *F01N 13/1838* (2013.01); *F01N 13/1805* (2013.01)

(58) Field of Classification Search
CPC .. F01N 13/18; F01N 13/1805; F01N 13/1827; F01N 13/1838; F01N 13/1844; F01N 13/185; F01N 2450/20; F01N 2470/10; F16L 23/036; F16L 23/04; F16L 23/12; F16L 23/16; F16L 13/14–168
See application file for complete search history.

(56) References Cited

U.S. PATENT DOCUMENTS 5,393,108 A * 2/1995 Kerr ..... F01N 13/1805 285/379
5,713,611 A * 2/1998 Kurimoto ..... B21D 39/06 29/523
2004/0094898 A1* 5/2004 Zheng ..... F16J 15/0881 277/314
2011/0215573 A1* 9/2011 Tanaka ..... F01N 13/08 29/523

(Continued)

FOREIGN PATENT DOCUMENTS

JP 2014010475 A 1/2014
JP 2022181467 A 12/2022

*Primary Examiner* — Loren C Edwards
(74) *Attorney, Agent, or Firm* — David D. Brush; Westman, Champlin & Koehler, P.A.

(57) ABSTRACT

In the present manufacturing method, a cover member attached to a mounting surface of a pressing jig is inserted into an approximately circular opening of an opening member. The cover member has an approximately elliptical inner circumferential portion. A long diameter of an outer circumference of the inner circumferential portion is equal to, or longer than, a diameter of the opening. A short diameter of the outer circumference of the inner circumferential portion is smaller than the diameter of the opening. A length of the outer circumference of the inner circumferential portion is shorter than or equal to a circumference length of the opening. A first imaginary line of the mounting surface indicates the inner circumferential portion of the cover member. A second imaginary line of the mounting surface indicates the opening. A positioning member is provided inside the first and second imaginary lines on the mounting surface.

11 Claims, 9 Drawing Sheets

(56) References Cited

U.S. PATENT DOCUMENTS

| | | | | |
|---|---|---|---|---|
| 2019/0170287 | A1* | 6/2019 | Fredenburg | F16L 23/162 |
| 2021/0148275 | A1* | 5/2021 | Hiraoka | F01N 13/1805 |
| 2022/0381175 | A1* | 12/2022 | Hiramatsu | F01N 13/1805 |

* cited by examiner

METHOD OF MANUFACTURING OPENING MEMBER, AND PRESSING JIG

CROSS-REFERENCE TO RELATED APPLICATIONS

This application claims the benefit of Japanese Patent Application No. 2023-112347 filed on Jul. 7, 2023 with the Japan Patent Office, the entire disclosure of which is incorporated herein by reference.

BACKGROUND

The present disclosure relates to a method of manufacturing an opening member, and so on.

Turbochargers for an engine of a vehicle, and peripheral components thereof, are required to be resistant to high temperature oxidation as well as repeated oxidation due to exposure to high temperature exhaust gas and repeated heating and cooling. To address this, Japanese Unexamined Patent Application Publication No. 2022-181467 discloses a technique for improving heat resistance of an exhaust pipe by providing a cover member at an opening of the exhaust pipe into which exhaust gas from a turbocharger flows to cover a region of an inner circumferential surface of the exhaust pipe around the opening.

SUMMARY

The cover member is a ring-shaped member, and comprises an inner circumferential portion and a held portion. The inner circumferential portion covers the inner circumferential surface of the exhaust pipe. The held portion extends outward from an end of the inner circumferential portion. The cover member is firstly inserted into the opening of the exhaust pipe so that the inner circumferential portion covers the inner circumferential surface of the exhaust pipe. Thereafter, to the opening of the exhaust pipe into which the cover member is inserted, another exhaust pipe on an upstream side is fastened with a v-band clamp or the like. At that time, the held portion of the cover member is held by end surfaces that surround openings of these exhaust pipes.

In one aspect of the present disclosure, it is desirable that the cover member is properly inserted into the opening.

One aspect of the present disclosure provides a method of manufacturing an opening member with an approximately circular opening at its end. The method comprises: attaching a cover member to a mounting surface of a pressing jig; and inserting the cover member attached to the mounting surface of the pressing jig into the opening. The cover member comprises an inner circumferential portion and a held portion. The inner circumferential portion is an approximately elliptical ring-shaped portion. When the cover member is inserted into the opening, an outer circumferential surface of the inner circumferential portion faces an inner circumferential surface surrounding an internal space of the opening member. The internal space communicates with the opening. The held portion extends outward from an end of the inner circumferential portion, and held by an end of the opening member and a miscellaneous member to be connected to the opening. A long diameter of an outer circumference of the inner circumferential portion is equal to, or longer than, a diameter of the opening. A short diameter of the outer circumference of the inner circumferential portion is shorter than the diameter of the opening. A length of the outer circumference of the inner circumferential portion is shorter than or equal to a circumference length of the opening. First and second imaginary lines are settable on the mounting surface. The first imaginary line indicates the inner circumferential portion of the cover member attached to the mounting surface. The second imaginary line indicates the opening upon insertion of the cover member attached to the mounting surface into the opening. A center of the inner circumferential portion indicated by the first imaginary line is approximately coincident with a center of the opening indicated by the second imaginary line. A positioning member is provided inside the first and second imaginary lines on the mounting surface. The positioning member is adjacent to a plurality of specific portions on the first imaginary line, and at least two of the plurality of specific portions face each other across the center of the first imaginary line and the center of the second imaginary line.

According to the above-described configuration, the positioning member allows appropriate positioning of the cover member upon attaching the cover member to the mounting surface of the pressing jig. Also, since the positioning member is located inside the second imaginary line, it is possible to inhibit the positioning member from interfering with insertion of the cover member into the opening of the opening member using the pressing jig. Thus, the cover member can be properly inserted into the opening.

In one aspect of the present disclosure, the plurality of specific portions may be located around at least three intersections of the first imaginary line and the second imaginary line.

According to the above-described configuration, positioning of the cover member upon attaching the cover member to the mounting surface of the pressing jig can be appropriately performed.

In one aspect of the present disclosure, the plurality of specific portions may be located around four intersections of the first imaginary line and the second imaginary line.

According to the above-described configuration, the cover member can be appropriately positioned upon attaching the cover member to the mounting surface of the pressing jig.

In one aspect of the present disclosure, the positioning member may protrude from the mounting surface of the pressing jig.

According to the above-described configuration, the cover member can be appropriately positioned upon attaching the cover member to the mounting surface of the pressing jig.

In one aspect of the present disclosure, the positioning member may include a plurality of round portions, and each of the plurality of round portions may extend along a rounded part at a rim of a region where the positioning member is provided on the mounting surface of the pressing jig. Each of the plurality of round portions may be adjacent to one of the plurality of specific portions.

According to the above-described configuration, the cover member can be appropriately positioned upon attaching the cover member to the mounting surface of the pressing jig.

In one aspect of the present disclosure, the positioning member may include at least one long portion extending along a direction of a long diameter of the inner circumferential portion, and at least one short portion extending along a direction of a short diameter of the inner circumferential portion. The inner circumferential portion has an approximately elliptical shape indicated by the first imaginary line.

According to the above-described configuration, the cover member can be appropriately positioned upon attaching the cover member to the mounting surface of the pressing jig.

In one aspect of the present disclosure, the at least one long portion may include two long portions, and the at least one short portion may include two short portions.

According to the above-described configuration, the cover member can be appropriately positioned upon attaching the cover member to the mounting surface of the pressing jig.

In one aspect of the present disclosure, the cover member may be attached to the mounting surface of the pressing jig by magnetic force.

According to the above-described configuration, the cover member can be conveniently attached to the mounting surface of the pressing jig.

In one aspect of the present disclosure, the opening member may be an exhaust pipe to be installed in a vehicle.

According to the above-described configuration, the cover member can be properly inserted into an opening of the exhaust pipe.

One aspect of the present disclosure may provide a pressing jig used in the above-described method of manufacturing an opening member.

Use of the pressing jig as such allows the cover member to be properly inserted into the opening of the opening member.

BRIEF DESCRIPTION OF THE DRAWINGS

Example embodiments of the present disclosure will be described hereinafter with reference to the accompanying drawings, in which.

DETAILED DESCRIPTION OF EXEMPLARY EMBODIMENTS

Embodiments of the present disclosure are not limited to the following embodiments, and may take various forms within the technical scope of the present disclosure.

1. First Exhaust Pipe

Figure 1:
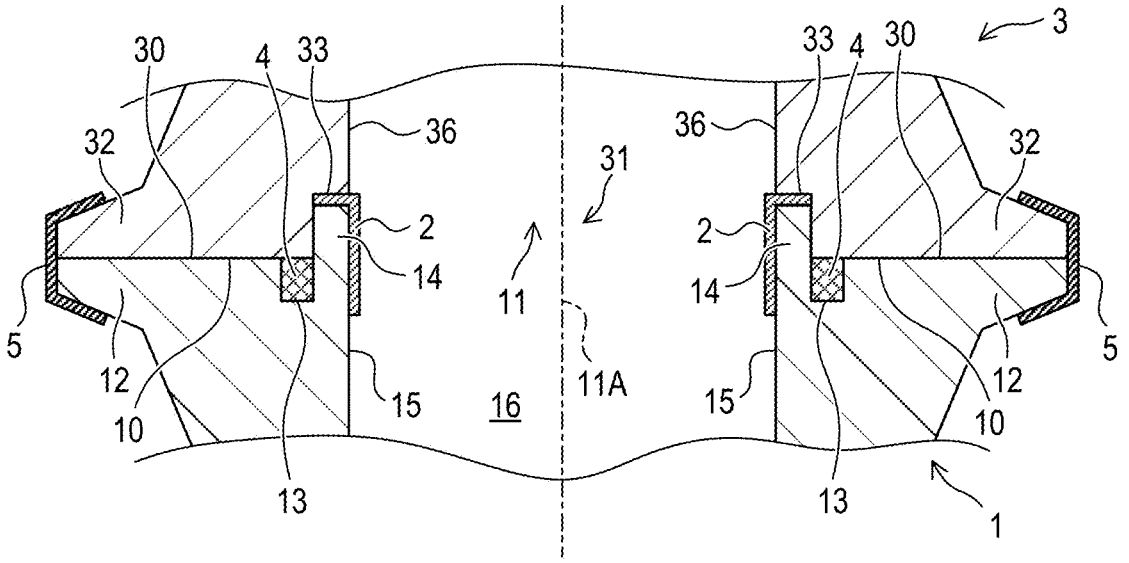
FIG. 1 is a cross-sectional view of first and second exhaust pipes fastened together along their axes.

A first exhaust pipe 1 forms a part a flow path of exhaust gas from an engine of a vehicle (see FIG. 1). As an example, the first exhaust pipe 1 is fastened with a v-band clamp 5 to a downstream side of a second exhaust pipe 3 (in other words, a miscellaneous member) that discharges the exhaust gas from a turbocharger. Also, the first exhaust pipe 1 is configured to accommodate a purification member (for example, a catalyst or a filter) for purifying the exhaust gas.

As an example, the first exhaust pipe 1 and the second exhaust pipe 3 may be made from austenitic stainless steel having heat resistance. However, the first exhaust pipe 1 and the second exhaust pipe 3 may be made from any steel material having heat resistance, other than austenitic stainless steel. Also, the second exhaust pipe 3 may be made from a material having higher heat resistance than a material forming the first exhaust pipe 1.

The first exhaust pipe 1 comprises a first end 10, a first opening 11, a first flange 12, and a cover member 2 to be described later (see FIGS. 1 to 3).

The first opening 11 is an approximately circular opening located at the first end 10 of the first exhaust pipe 1, and communicates with an internal space 16 of the first exhaust pipe 1. The first opening 11 is located on an upstream side of the first exhaust pipe 1 in a flow direction of the exhaust gas, and is connected to the second exhaust pipe 3. Hereinafter, a straight line that passes a center of the first opening 11 and is orthogonal to the first opening 11 is referred to as an axis 11A.

The first flange 12 is provided at the first end 10 of the first exhaust pipe 1, and is used for fastening to the second exhaust pipe 3.

The first end 10 surrounds the first opening 11, and has a flat surface extending in a direction orthogonal to the axis 11A of the first opening 11. The first end 10 includes a groove 13 and a first rim 14.

The first rim 14 protrudes toward the second exhaust pipe 3 from the first end 10 along the axis 11A. The first rim 14 is adjacent to the first opening 11, and surrounds the first opening 11. A holding surface 14A located at a top of the first rim 14 is a flat surface extending in a direction orthogonal to the axis 11A. Also, an inner circumferential surface of the first rim 14 forms an inner circumferential surface 15 that surrounds the internal space 16 of the first exhaust pipe 1.

Figure 2:
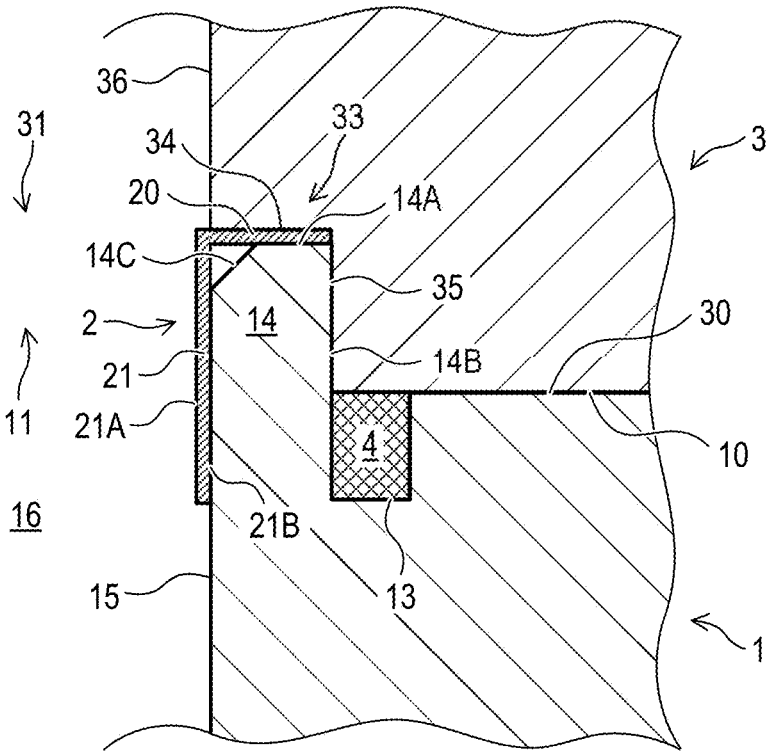
FIG. 2 is an enlarged view around a cover member and a first rim in the cross-sectional view of FIG. 1.

In addition, a chamfered portion 14C is formed at a boundary between the holding surface 14A and the inner circumferential surface 15 of the first rim 14 (see FIG. 2). The chamfered portion 14C is formed to surround the first opening 11, and tilted away from the axis 11A as it approaches the first end 10. The chamfered portion 14C is tilted, for example, at 10 to 80 degrees, more preferably at 45 degrees, relative to the axis 11A.

The groove 13 is provided at the first end 10, and surrounds the first opening 11. The groove 13 is provided adjacent to an outer side of the first rim 14. An outer circumferential surface 14B of the first rim 14 protrudes from a bottom surface of the groove 13 along the axis 11A. A ring-shaped gasket 4 is arranged in the groove 13 in order to seal a gap between the first opening 11 and a second opening 31 of the second exhaust pipe 3.

2. Second Exhaust Pipe

The second exhaust pipe 3 comprises a second end 30, the second opening 31, and a second flange 32 (see FIGS. 1 and 2).

The second opening 31 is located at the second end 30 of the second exhaust pipe 3. Also, the second opening 31 is connected to the first opening 11 of the first exhaust pipe 1, and has the same shape as the first opening 11 (as an example, an approximately circular shape).

The second flange 32 is provided at the second end 30 of the second exhaust pipe 3, and is used for fastening to the first exhaust pipe 1.

The second end 30 surrounds the second opening 31, and has a flat surface extending in a direction orthogonal to the axis 11A of the first opening 11 of the first exhaust pipe 1 that is connected to the second opening 31. The second end 30 has a depression 33.

The depression 33 is formed on the second end 30 to be adjacent to the second opening 31 and surround the second opening 31. The depression 33 has a bottom surface 34 and a first inner circumferential surface 35.

The bottom surface 34 is a flat portion extending in a direction orthogonal to the axis 11A of the first opening 11 that is connected to the second opening 31, and is provided to circle around an inner circumferential surface of the second exhaust pipe 3. Also, the bottom surface 34 forms a stepped portion on the inner circumferential surface of the second exhaust pipe 3, and partitions the inner circumferential surface into the first inner circumferential surface 35 and a second inner circumferential surface 36.

The first inner circumferential surface 35 is adjacent to the second opening 31, and surrounds the second opening 31. Also, the first inner circumferential surface 35 is adjacent to the second inner circumferential surface 36 across the bottom surface 34. The first inner circumferential surface 35 has a larger diameter than the second inner circumferential surface 36.

3. Cover Member

Figure 3:
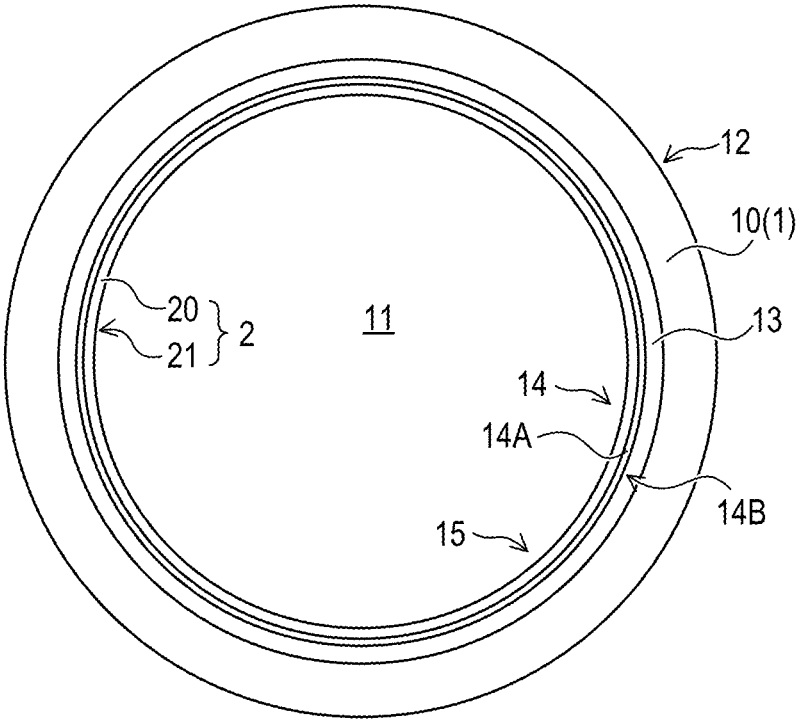
FIG. 3 is a front view of a first end of a first exhaust pipe to which the cover member is attached.

The cover member 2 is provided at the first end 10 of the first exhaust pipe 1, and held by the first end 10 and the second end 30 of the second exhaust pipe 3 that are fastened together (see FIGS. 1 to 3). The cover member 2 is a ring-shaped member provided to surround the first opening 11. The cover member 2 comprises a held portion 20 and an inner circumferential portion 21, and has an L-shaped cross section orthogonal to its circumferential direction.

The inner circumferential portion 21 is a flat ring-shaped member. A width direction of the inner circumferential portion 21 is approximately coincident with a direction orthogonal to a radial direction of the cover member 2. An outer circumferential surface 21B of the inner circumferential portion 21 faces a region on the inner circumferential surface 15 of the first exhaust pipe 1 around the first opening 11. Specifically, the outer circumferential surface 21B of the inner circumferential portion 21 contacts that region, or is arranged with a gap relative to that region.

The held portion 20 is also a flat ring-shaped member. A width direction of the held portion 20 is approximately coincident with the radial direction of the cover member 2. The held portion 20 extends outward from an end of the inner circumferential portion 21 in the width direction. The held portion 20 is held by the holding surface 14A of the first rim 14 of the first exhaust pipe 1 and the bottom surface 34 of the depression 33 of the second exhaust pipe 3.

The cover member 2 is made from a material having higher heat resistance than the material forming the first end 10 of the first exhaust pipe 1, and so on. Specifically, the cover member 2, as an example, may be made from ferritic steel material. Of course, the cover member 2 may be made from other materials. In addition, heat resistance of the material forming the cover member 2 may be approximately the same as, or lower than, that of the material forming the first end 10 of the first exhaust pipe 1, and so on.

4. Attachment of Cover Member

Next, a method of attaching the cover member 2 to the first end 10 of the first exhaust pipe 1, in other words, a method of manufacturing the first exhaust pipe 1 with the cover member 2 attached to the first end 10 will be described.

[(1) Cover Member Before and After Attachment]

Figure 4:
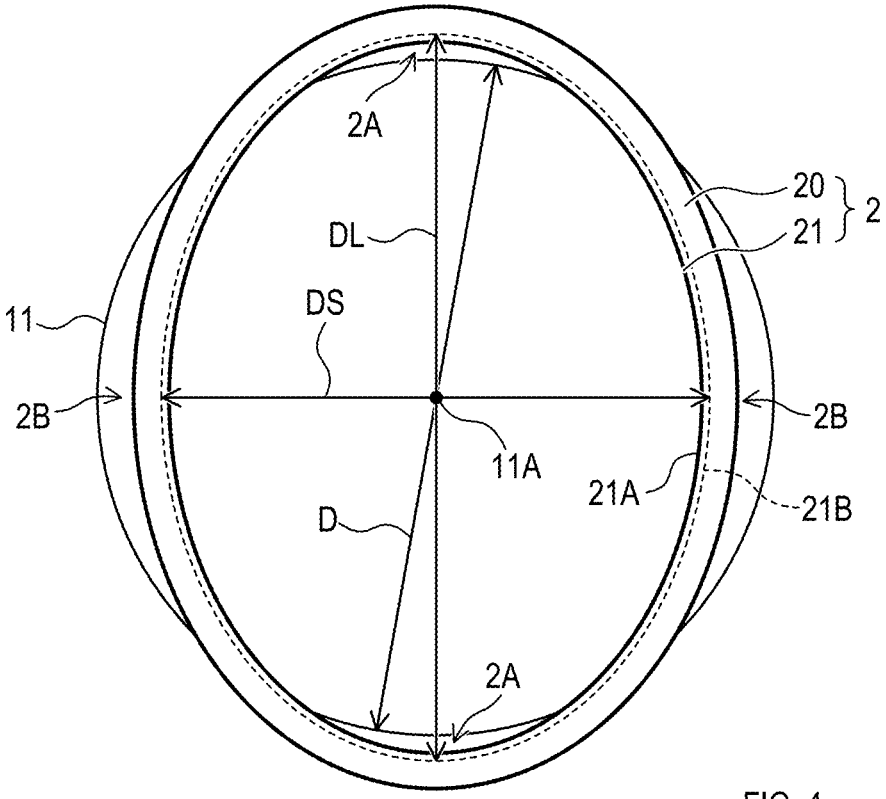
FIG. 4 is a front view of a first opening, and the cover member before attachment to the first end.

The cover member 2 before attachment to the first end 10 has an approximately elliptical ring shape (see FIG. 4). Specifically, an approximately elliptical long diameter DL formed by the outer circumferential surface 21B of the inner circumferential portion 21 is larger than a diameter D of the first opening 11, and a short diameter DS of the approximate ellipse is smaller than the diameter D of the first opening 11. The long diameter DL may be equal to the diameter D. Also, a circumference length of the approximate ellipse, in other words, a circumferential length of the outer circumferential surface 21B is shorter than a circumference length of the first opening 11.

Attachment of the cover member 2 to the first end 10 is performed by a plurality of processes which include an attachment process and an insertion process. The cover member 2 attached to the first end 10 is arranged along a circumference of the first opening 11 in an elastically deformed state, and has an approximately circular shape, or an approximately elliptical shape with the long diameter DL shortened and the short diameter DS extended. Accordingly, a position of the cover member 2 can be maintained by elastic force of the cover member 2.

If the cover member 2 attached to the first end 10 has an approximately elliptical shape, then the outer circumferential surface 21B of the inner circumferential portion 21 at each of two long diameter portions 2A of the cover member 2 after the attachment is in contact with the inner circumferential surface 15 of the first exhaust pipe 1. On the other hand, the outer circumferential surface 21B at each of two short diameter portions 2B of the cover member 2 is arranged with a gap relative to the inner circumferential surface 15 of the first exhaust pipe 1.

The long diameter portion 2A indicates a region of the cover member 2, before attachment to the first end 10, around each end of the long diameter DL. A region of the cover member 2, after attachment to the first end 10, which corresponds to the long diameter portion 2A of the cover member 2 before the attachment is also referred to as the long diameter portion 2A. The short diameter portion 2B indicates a region of the cover member 2, before attachment to the first end 10, around each end of the short diameter DS. A region of the cover member 2, after attachment to the first end 10, which corresponds to the short diameter portion 2B of the cover member 2 before the attachment is also referred to as the short diameter portion 2B.

[(2) Pressing Jig]

Figure 5:
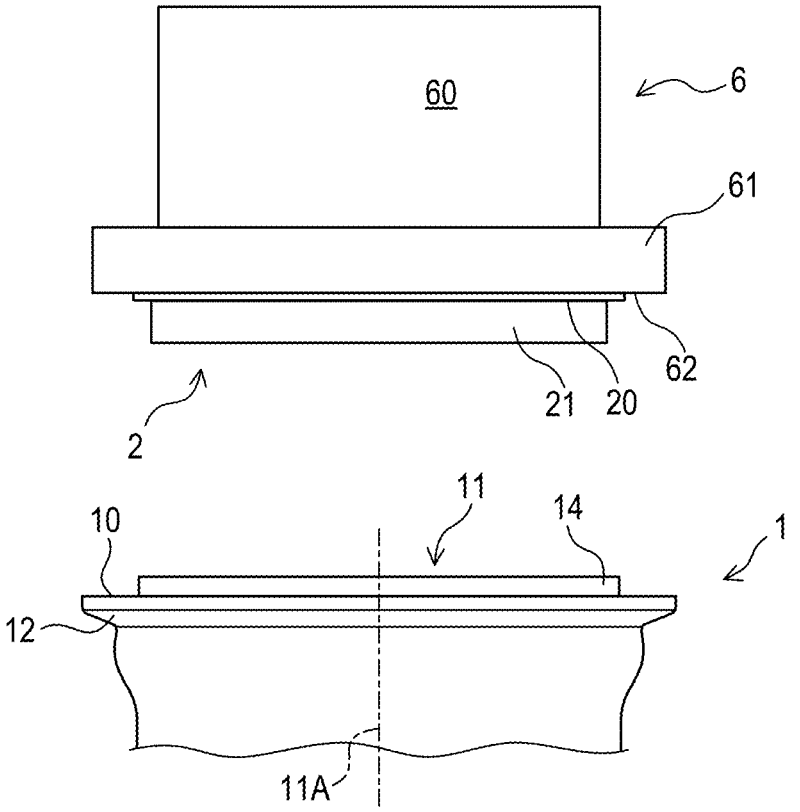
FIG. 5 is a side view of a pressing jig and the first exhaust pipe.
Figure 6:
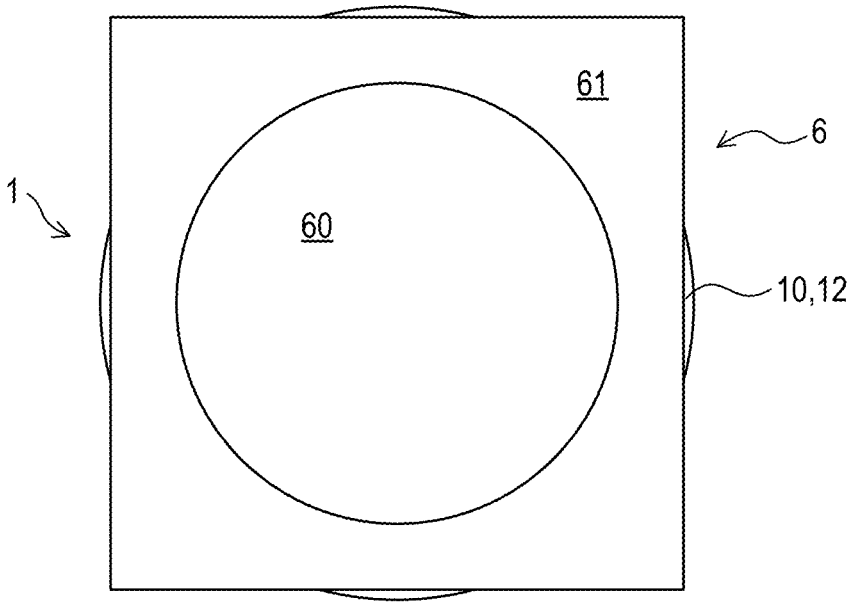
FIG. 6 is a top view of the pressing jig and the first exhaust pipe in an insertion process, viewed from a side of the pressing jig.
Figure 7:
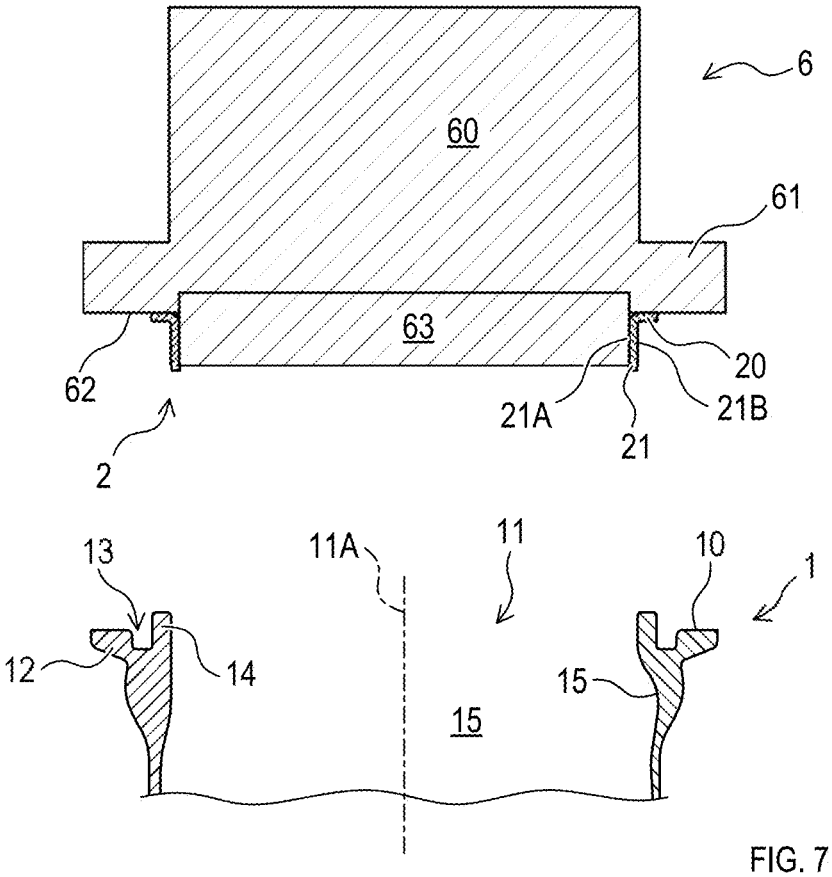
FIG. 7 is a cross-sectional view of the pressing jig and the first exhaust pipe in the insertion process.

A pressing jig 6 is used for attachment of the cover member 2 (see FIGS. 5 to 7). The pressing jig 6 comprises a cylindrical base 60, a rectangular thick plate-like bottom portion 61, and a positioning member 63 (in other words, a core metal).

On an outer surface of the bottom portion 61, square-shaped first and second surfaces are formed which face a thickness direction of the pressing jig 6. The base 60 is provided to protrude from the first surface of the bottom portion 61. On the other hand, the second surface of the bottom portion 61 is formed as a mounting surface 62 to which the cover member 2 can be attached. As an example, the cover member 2 is attached to the mounting surface 62 by magnetic force caused by a magnet installed inside the bottom portion 61. At this time, a surface of the held portion 20 of the cover member 2 that contacts the second end 30 of the second exhaust pipe 3 comes into contact with the mounting surface 62, resulting in that the inner circumferential portion 21 protrudes from the mounting surface 62. Of course, the cover member 2 can be attached to the mounting surface 62 by various methods, such as fastening and adhesion, other than magnetic force.

The positioning member 63 positions the cover member 2 to be attached to the mounting surface 62. The positioning member 63 is provided to protrude from the mounting surface 62 of the bottom portion 61. The cover member 2 is attached to the mounting surface 62 with the positioning member 63 located inward from the inner circumferential portion 21.

Here, first and second imaginary lines 64, 65 can be set on the mounting surface 62 (see FIGS. 8 and 11 to 17). The first imaginary line 64 indicates the inner circumferential portion 21 of the cover member 2 attached to the mounting surface 62. The second imaginary line 65 indicates the circumference of the first opening 11 upon inserting the cover member 2 attached to the mounting surface 62. In other words, the first imaginary line 64 has an approximately elliptical shape, and the second imaginary line 65 has an approximately circular shape. The center of the inner circumferential portion 21 indicated by the first imaginary line 64 and the center of the first opening 11 indicated by the second imaginary line 65 is approximately coincident with each other.

As an example, the first and second imaginary lines 64, 65 are imaginary lines that are not actually provided on the mounting surface 62. However, the first and second imaginary lines 64, 65 may be actually provided on the mounting surface 62; for example, the first and second imaginary lines 64, 65 may be drawn on the mounting surface 62.

The positioning member 63 is provided inside the first and second imaginary lines 64, 65 on the mounting surface 62, and is adjacent to at least two specific portions 64A of the first imaginary line 64. In the present disclosure, the word "adjacent" is a concept that includes "contact". That is, the positioning member 63 adjacent to the specific portions 64A has a small gap relative to the specific portions 64A, or is in contact with the specific portions 64A. Two of these specific portions 64A face each other across a center of the first imaginary line 64 and the second imaginary line 65.

Figure 8:
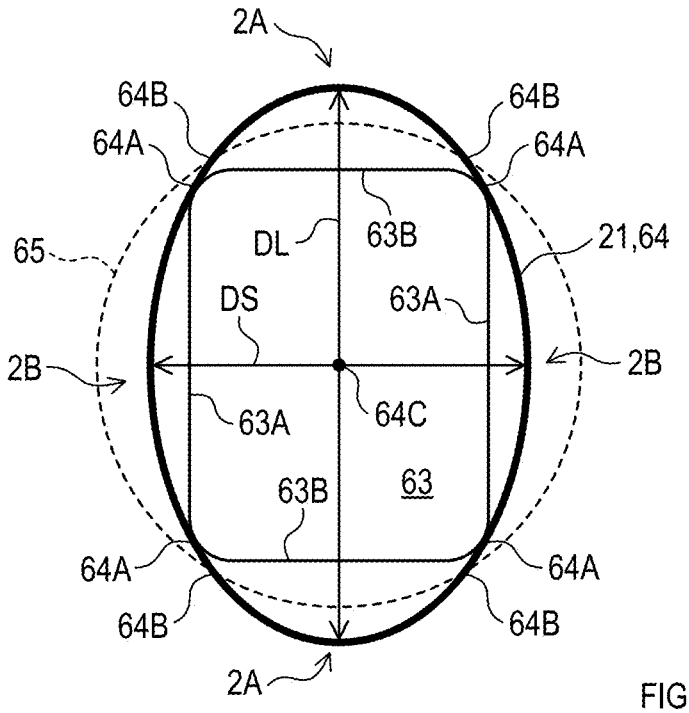
FIG. 8 is an explanatory diagram of a mounting surface.

As an example, the positioning member 63 is provided in an approximately rectangular region of the mounting surface 62 (see FIG. 8). That is, the positioning member 63, when viewed from the front of the mounting surface 62, has an approximately rectangular shape. At a rim of the positioning member 63, two long portions 63A extending approximately linearly along a direction of the long diameter DL of the outer circumferential surface 21B of the inner circumferential portion 21 indicated by the first imaginary line 64, and two short portions 63B extending approximately linearly along a direction of the short diameter DS of the outer circumferential surface 21B are formed. Hereinafter, the long diameter DL and the short diameter DS of the outer circumferential surface 21B of the inner circumferential portion 21 indicated by the first imaginary line 64 may be simply referred to as the long diameter DL and the short diameter DS, respectively.

Four corners of the positioning member 63 are each rounded, and adjacent to the first imaginary line 64 around four intersections between the first imaginary line 64 and the second imaginary line 65 (hereinafter, imaginary intersections 64B). That is, four points on the first imaginary line 64 adjacent to these corners correspond to the specific portions 64A, and these specific portions 64A are located around the four imaginary intersections 64B. In addition, each of the specific portions 64A faces one of the other specific portions 64A across the center of the first and second imaginary lines 64, 65 (hereinafter, referred to as an imaginary center 64C).

That is, the four corners of the positioning member 63 form round portions. Each of the round portions extends along a rounded part at a rim of the region where the positioning member 63 is provided on the mounting surface 62. When viewed facing the mounting surface 62, each of the round portions has a smaller curvature radius than the specific portion adjacent to that round portion.

[(3) Attachment Process and Insertion Process]

In the attachment process, the cover member 2 is attached to the mounting surface 62 to surround the positioning member 63 in a state where the direction of the long diameter DL is coincident with a direction of the long portions 63A of the positioning member 63 (See FIGS. 5, 7, and 8). At this time, the four corners of the positioning member 63 are adjacent to an inner circumferential surface 21A of the inner circumferential portion 21 of the cover member 2. Thus, the inner circumferential portion 21 of the cover member 2 is arranged along the first imaginary line 64.

In the subsequent insertion process, firstly, the first exhaust pipe 1 is fixed by a fixing jig (not shown) provided around the first end 10 of the first exhaust pipe 1. Then, in a state where the cover member 2 attached to the mounting surface 62 of the pressing jig 6 is arranged at an insertion position determined based on the first exhaust pipe 1 (for example, the first opening 11), for example, in a state where the imaginary center 64C is coincident with the axis 11A, the cover member 2 is brought closer to the first opening 11, and inserted into the first opening 11 (see FIG. 7).

When the cover member 2 is inserted into the first opening 11, the cover member 2 arranged along the first imaginary line 64 is deformed into an approximately circular shape, and is brought into a state where the cover member 2 extends along the second imaginary line 65 on the mounting surface 62. By moving the pressing jig 6 away from the first opening 11 after the insertion, the cover member 2 is separated from the mounting surface 62 while being inserted into the first opening 11. Then, attachment of the cover member 2 is complete.

Figure 9:
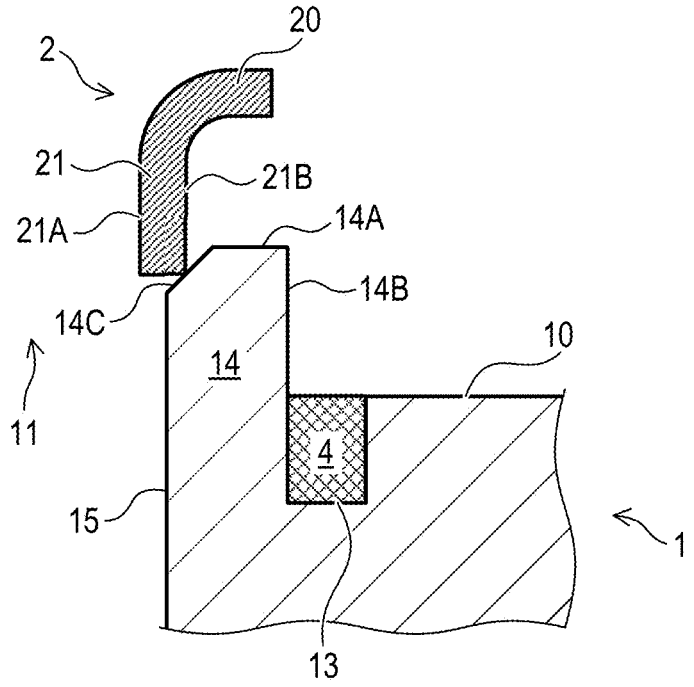
FIG. 9 is an explanatory diagram of the cover member and a chamfered portion in the insertion process.
Figure 10:
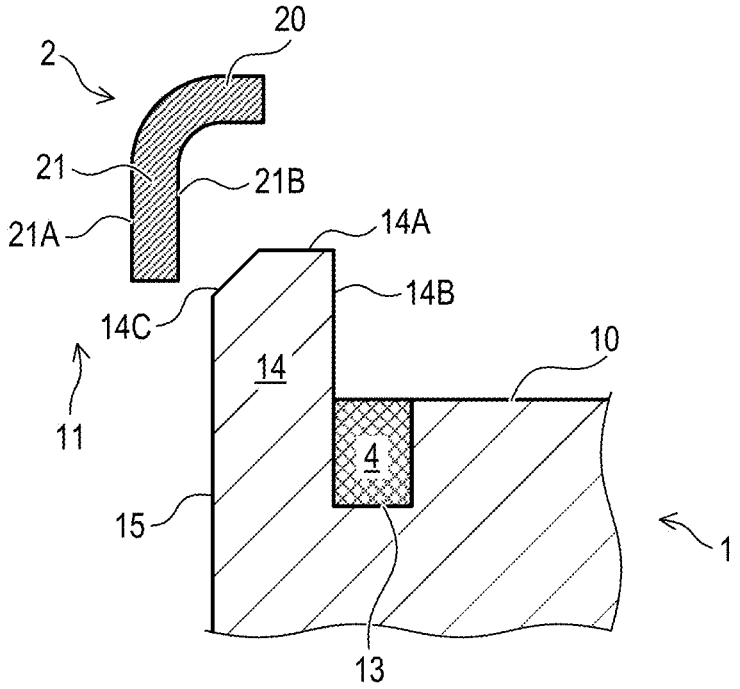
FIG. 10 is an explanatory diagram of the cover member and the chamfered portion in the insertion process.

Also, during the insertion of the cover member 2, an end of the inner circumferential portion 21 at each of the long diameter portions 2A of the cover member 2 hits the chamfered portion 14C of the first exhaust pipe 1 (see FIG. 9). Then, the inner circumferential portion 21 enters the first opening 11 while being deformed to tilt inward due to a slope of the chamfered portion 14C. On the other hand, the inner circumferential portion 21 at each of the short diameter portions 2B is located inward from the chamfered portion 14C of the first exhaust pipe 1, and an end of the inner circumferential portion 21 at each of the short diameter portions 2B enters the first opening 11 without hitting the holding surface 14A and the chamfered portion 14C (see FIG. 10).

For example, by adjusting a relative position between a mark (not shown) set on the pressing jig 6 and a specific part of the first exhaust pipe 1, the cover member 2 may be arranged at the insertion position. Also, as an example, by pressing the pressing jig 6 toward the first opening 11, the cover member 2 may be press fit into the first opening 11.

In addition, by inserting the cover member 2 located at the insertion position into the first opening 11, the inner circumferential portion 21 located at each of the long diameter portions 2A of the cover member 2 is arranged at a region of the inner circumferential surface 15 of the first exhaust pipe 1 susceptible to damage (hereinafter, referred to as a weak region). This can bring the inner circumferential portion 21 of the cover member 2 attached to the first opening 11 into contact with the weak region, and inhibits the exhaust gas from directly hitting the weak region. Specifically, for example, a region where a flow of deflected exhaust gas tends to concentrate, or a region that tends to have relatively high temperature may be the weak region. Or, in a case where a waste gate is provided inside the second exhaust pipe 3, a region where a flow of exhaust gas leaked from the waste gate tends to concentrate may be the weak region. In addition to this, for example, a region of the first exhaust pipe 1 with thin wall and low strength, or a region where stress tends to concentrate may be the weak region. Moreover, for example, it is assumed that a positioning member including a depression, projection or the like is provided at a region in a circumferential direction of the cover member 2. In this case, it is considered to provide a positioned member corresponding to a circumferential-direction positioning member and including a protrusion or a depression at an edge of the first opening 11 of the first exhaust pipe 1. In a case as such, the positioned member will be the weak region.

On the other hand, the inner circumferential portion 21 of the cover member 2 located at each of the short diameter portions 2B is brought into contact with the inner circumferential surface 15 of the first exhaust pipe 1, or into a state where there is a gap relative to the inner circumferential surface 15.

Thereafter, for example, with the v-band clamp 5 or the like, the first end 10 of the first exhaust pipe 1 with the cover member 2 and the second end 30 of the second exhaust pipe 3 are fastened together.

5. Modified Examples of Positioning Member

(1) Modified Example 1

Figure 11:
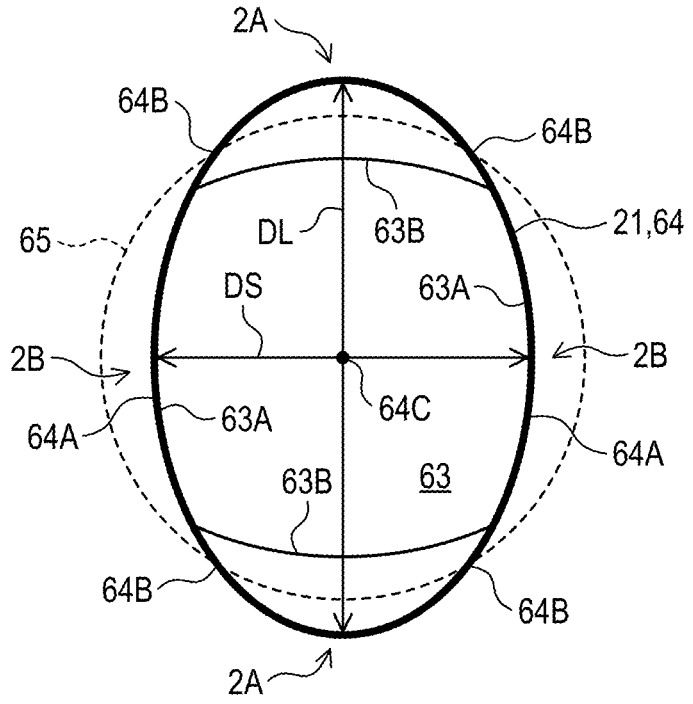
FIG. 11 is an explanatory diagram of the mounting surface in a modified example 1.

As shown in FIG. 11, the positioning member 63 of the above-described embodiment may be provided in an approximately rectangular region where long sides and short sides are curved in an arc so that centers of the long sides and the short sides bulge outward. That is, the positioning member 63 has an approximately rectangular shape, but both the long portions 63A and the short portions 63B are arc-shaped. The entire region of each of the long portions 63A is adjacent to one of two segments of the first imaginary line 64 that extend along the long diameter DL and face each other across the imaginary center 64C. That is, the two segments are the specific portions 64A. Also, these specific portions 64A are located around the four imaginary intersections 64B. Each of the long portions 63A may be partially adjacent to the segments. On the other hand, each of the short portions 63B is located away from the first and second imaginary lines 64, 65.

In the attachment process, in a state where the direction of the long diameter DL is approximately coincident with the direction of the long portions 63A of the positioning member 63, the cover member 2 is attached to the mounting surface 62 to surround the positioning member 63. At this time, each of the long portions 63A is adjacent to the inner circumferential surface 21A of the inner circumferential portion 21 located at the segment including one of the short diameter portions 2B of the cover member 2. As a result, the inner circumferential portion 21 of the cover member 2 is arranged along the first imaginary line 64.

(2) Modified Example 2

Figure 12:
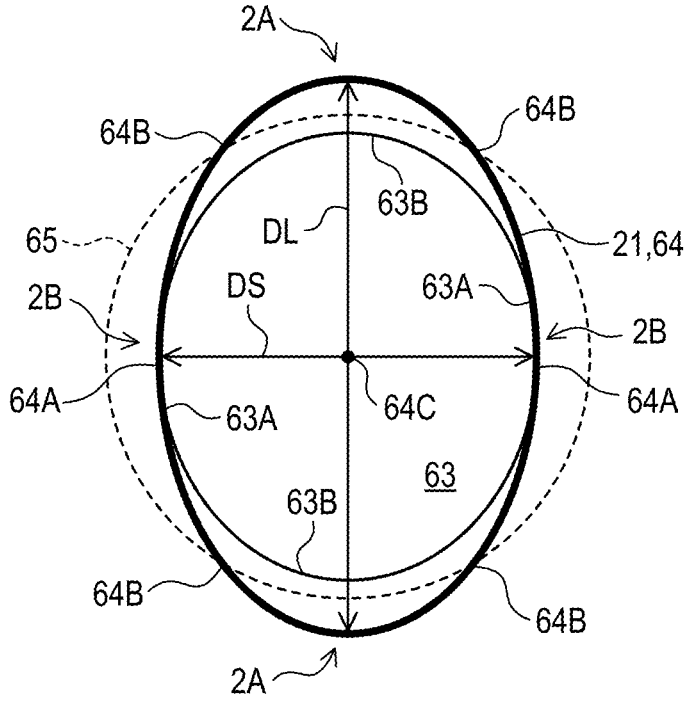
FIG. 12 is an explanatory diagram of the mounting surface in a modified example 2.

As shown in FIG. 12, the positioning member 63 may be arranged in an approximately elliptical region where a direction of its long diameter and a direction of its short diameter are respectively coincident with the direction of the long diameter DL and the direction of the short diameter DS of the first imaginary line 64. At a rim of the positioning member 63, the two long portions 63A passing ends of the short diameter and extending along the direction of the long diameter DL of first imaginary line 64, and the two short portions 63B passing ends of the long diameter and extending along the direction of the short diameter DS of the first imaginary line 64 are formed. Each of the long portions 63A passes an end of the short diameter DS on the first imaginary line 64, and is adjacent to one of the two segments facing each other across the imaginary center 64C. That is, the two segments are the specific portions 64A. On the other hand, each of the short portions 63B is located away from the first and second imaginary lines 64, 65.

In the attachment process, in a state where the direction of the long diameter DL is approximately coincident with the direction of the long diameter of the positioning member 63, the cover member 2 is attached to the mounting surface 62 to surround the positioning member 63. At this time, each of the long portions 63A is adjacent to the inner circumferential surface 21A of the inner circumferential portion 21 located at one of the short diameter portions 2B of the cover member 2. As a result, the inner circumferential portion 21 of the cover member 2 is arranged along the first imaginary line 64.

(3) Modified Example 3

Figure 13:
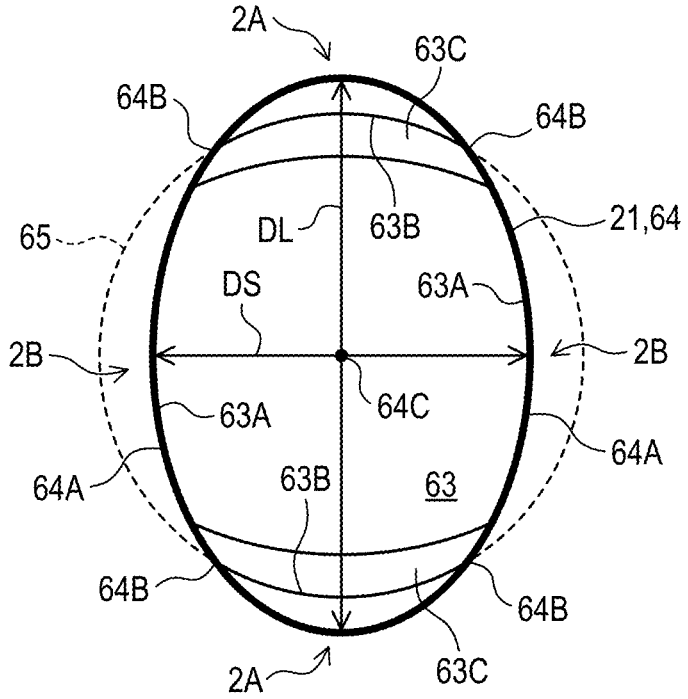
FIG. 13 is an explanatory diagram of the mounting surface in a modified example 3.

As shown in FIG. 13, the positioning member 63 may be provided in an approximately elliptical region corresponding to the entire region inside the first and second imaginary lines 64, 65. That is, each of the long portions 63A extending along the long diameter at the rim of the positioning member 63 is adjacent to one of two segments of the first imaginary line 64 located inside the second imaginary line 65 and facing each other across the imaginary center 64C. That is, the two segments are the specific portions 64A. Also, these specific portions 64A are located around the four imaginary intersections 64B. Each of the long portions 63A may be partially adjacent to one of the segments.

Also, each of the two short portions 63B that extend along a short diameter at the rim of the positioning member 63 is adjacent to the entire region of each of two segments of the second imaginary line 65 located inside the first imaginary line 64. Further, the positioning member 63 is provided with an elastic portion 63C corresponding to each of the short portions 63B. The elastic portion 63C is configured to displace the short portion 63B toward the center of the positioning member 63 along the direction of the long diameter in response to pressure from outside, and return to their original position by elastic force. Specifically, the elastic portion 63C may be, for example, a portion of the positioning member 63 made from an elastic material provided around the short portion 63B, or a portion including a spring or the like installed inside the positioning member 63.

In the attachment process, the cover member 2 is attached to the mounting surface 62 to surround the positioning member 63, in a state where the direction of the long diameter DL is approximately coincident with the direction of the long portions 63A. At this time, each of the long portions 63A is adjacent to the inner circumferential surface 21A of the inner circumferential portion 21 located at the segment including one of the short diameter portions 2B of the cover member 2. Thus, the inner circumferential portion 21 of the cover member 2 is arranged along the first imaginary line 64.

Also, when the cover member 2 is inserted into the first opening 11 in the insertion process, the cover member 2 is deformed to have an extended shape along the second imaginary line 65 of the mounting surface 62. Each of the short portions 63B of the positioning member 63 is adjacent to the cover member 2 after the insertion. At this time, by deforming each of the short portions 63B toward the center by the elastic portion 63C, the cover member 2 is easily separated from the mounting surface 62.

(4) Modified Example 4

Figure 14:
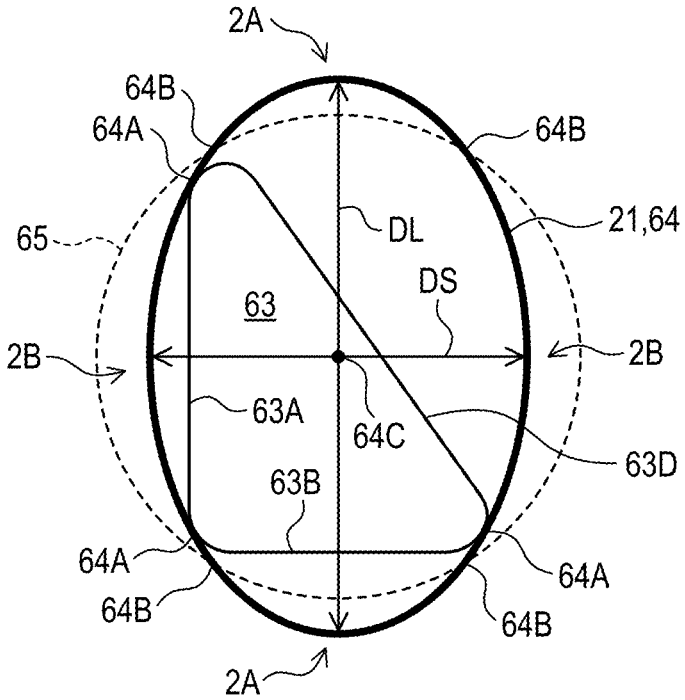
FIG. 14 is an explanatory diagram of the mounting surface in a modified example 4.

As shown in FIG. 14, the positioning member 63 may be provided in an approximately right triangular region of the mounting surface 62. That is, when viewed from the front of the mounting surface 62, the positioning member 63 has an approximately right triangular shape. At a rim of the positioning member 63, the long portion 63A extending approximately linearly along the direction of the long diameter DL of the first imaginary line 64, and the short portion 63B extending approximately linearly along the direction of the short diameter DS are formed.

Three corners of the positioning member 63 are each rounded, and are adjacent to the first imaginary line 64 around the different imaginary intersections 64B. That is, three locations on the first imaginary line 64 that are adjacent to these corners correspond to the specific portions 64A, and these specific portions 64A are located around the three imaginary intersections 64B. In addition, two of these specific portions 64A face each other along a portion forming a hypotenuse of the positioning member 63 (hereinafter, referred to as a hypotenuse portion 63D) across the imaginary center 64C. In other words, these three corners form the aforementioned round portions.

In the attachment process, the cover member 2 is attached to the mounting surface 62 so that the three corners of the positioning member 63 are adjacent to the inner circumferential surface 21A of the inner circumferential portion 21 of the cover member 2. Thus, the inner circumferential portion 21 of the cover member 2 is arranged along the first imaginary line 64.

(5) Modified Example 5

Figure 15:
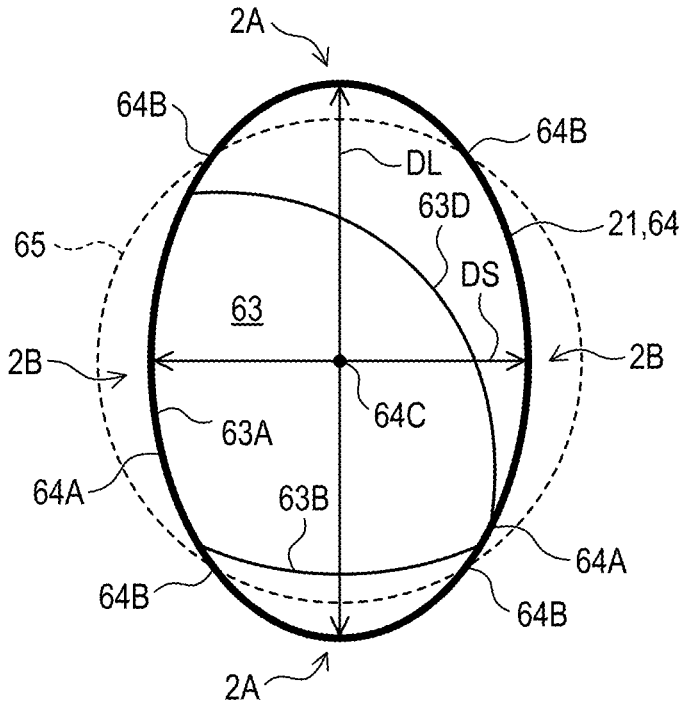
FIG. 15 is an explanatory diagram of the mounting surface in a modified example 5.

As shown in FIG. 15, the positioning member 63 of the modified example 4 may be provided in an approximately right triangular region where each side is curved in an arc so that a center of the side bulges outward. That is, the positioning member 63 has an approximately right triangular shape while the long portion 63A, the short portion 63B, and the hypotenuse portion 63D have an arc shape.

The whole region of the long portion 63A is adjacent to one of the two segments extending along the long diameter DL of the first imaginary line 64. That is, the one of the segments of the first imaginary line 64 correspond to the specific portion 64A. The long portion 63A may be partially adjacent to the segment. Also, the corner located between the short portion 63B and the hypotenuse portion 63D is adjacent to the first imaginary line 64. That is, two locations on the first imaginary line 64 that are adjacent to the long portion 63A and the corner correspond to the specific portions 64A. These specific portions 64A are located around the three imaginary intersections 64B. Also, the specific portion 64A adjacent to the corner faces an end of the specific portion 64A adjacent to the long portion 63A across the imaginary center 64C. On the other hand, the short portion 63B and the hypotenuse portion 63D are located away from the first and second imaginary lines 64, 65.

In the attachment process, the cover member 2 is attached to the mounting surface 62 to surround the positioning member 63, in a state where the direction of the long diameter DL is approximately coincident with the direction of the long portion 63A of the positioning member 63. At this time, the long portion 63A, and a corner between the short portion 63B and the hypotenuse portion 63D, are adjacent to the inner circumferential surface 21A of the inner circumferential portion 21 located in the segments including the short diameter portions 2B of the cover member 2. Thus, the inner circumferential portion 21 of the cover member 2 is arranged along the first imaginary line 64.

(6) Modified Example 6

Figure 16:
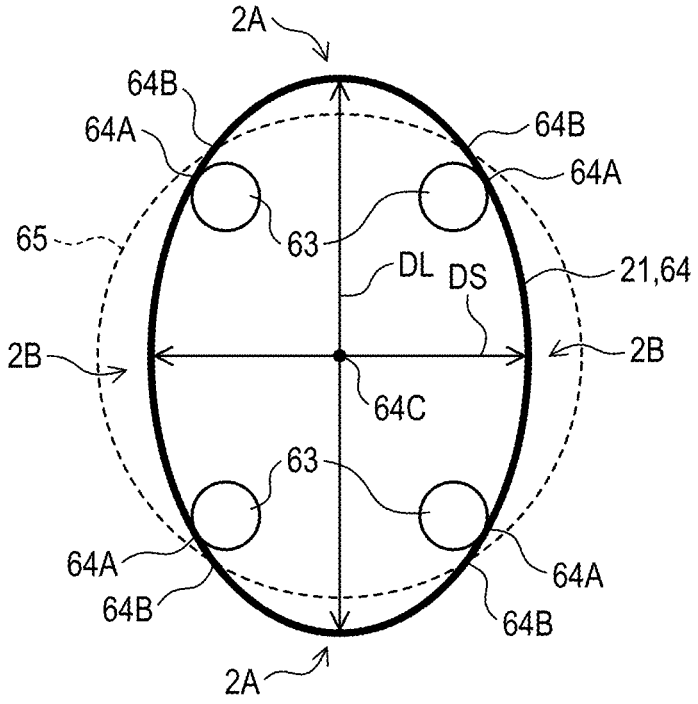
FIG. 16 is an explanatory diagram of the mounting surface in a modified example 6.

As shown in FIG. 16, the positioning member 63 may include four portions provided in four approximately circular regions on the mounting surface 62. That is, each of the portions of the positioning member 63 has an approximately circular shape, when viewed from the front of the mounting surface 62.

Each of the portions (hereinafter, referred to as circular portions) of the positioning member 63 is adjacent to the imaginary intersections 64B and the first imaginary line 64. That is, four locations on the first imaginary line 64 that are adjacent to these circular portions correspond to the specific portions 64A, and each of these specific portions 64A is located around one of the four imaginary intersections 64B. Also, each of the specific portions 64A faces one of the other specific portions 64A across the imaginary center 64C. In other words, each circular portion forms the aforementioned round portion.

In the attachment process, the cover member 2 is attached to the mounting surface 62 so that the four circular portions of the positioning member 63 are adjacent to the inner circumferential surface 21A of the inner circumferential portion 21 of the cover member 2. Thus, the inner circumferential portion 21 of the cover member 2 is arranged along the first imaginary line 64.

Figure 17:
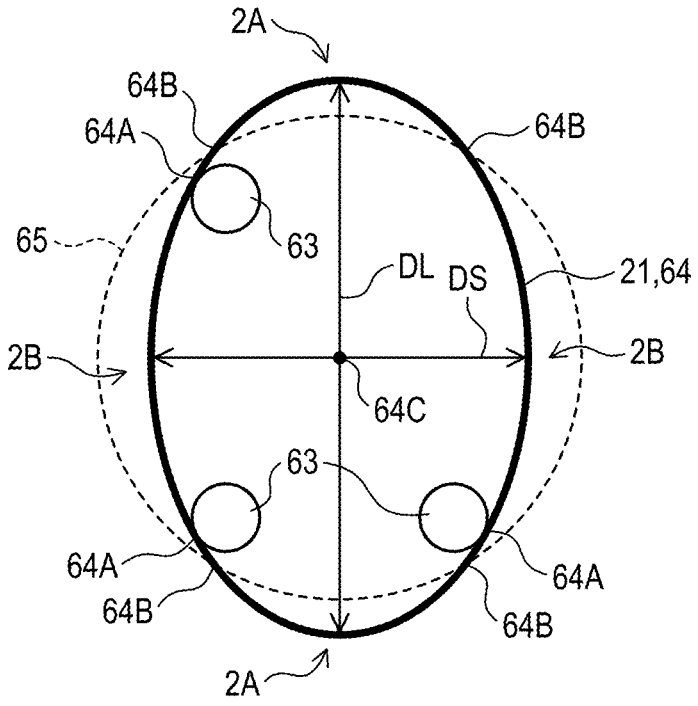
FIG. 17 is an explanatory diagram of the mounting surface in a modified example 6.

The number of the circular portions in the modified example 6 may be three as shown in FIG. 17, or may be two. When there are two circular portions, these circular portions are arranged to face each other across the imaginary center 64C. That is, the specific portions 64A on the first imaginary line 64 to which these circular portions are adjacent are arranged across the imaginary center 64C.

Also, there may be five or more circular portions. In this case, four circular portions are arranged as in FIG. 16, and a further circular portion is provided to be adjacent to the first imaginary line 64 between the circular portions lined up along the long diameter DL.

6. Effect (1) According to the above-described embodiment, the cover member 2 can be attached to the mounting surface 62 of the pressing jig 6 along the first imaginary line 64 by arranging the cover member 2 to surround the positioning member 63 in the attachment process. Thus, positioning of the cover member 2 can be appropriately performed. Also, since the positioning member 63 is located inside the second imaginary line 65 that indicates the first opening 11 of the first exhaust pipe 1, it is possible in the insertion process to inhibit the positioning member 63 from interfering with the insertion of the cover member 2 into the first opening 11. Thus, the cover member 2 can be properly inserted into the first opening 11.

(2) Also, while it becomes easier for the inner circumferential portion 21 to contact the inner circumferential surface 15 of the first exhaust pipe 1 around the long diameter portions 2A of the elliptical cover member 2, a gap may be generated between the inner circumferential portion 21 and the inner circumferential surface 15 of the first exhaust pipe 1 around the short diameter portions 2B. On the other hand, the exhaust gas tends to be deflected on the downstream side of the turbocharger. Thus, if a flow of high-temperature exhaust gas concentrates on a region around the short diameter portion 2B of the cover member 2, then the exhaust gas directly hits the inner circumferential surface 15 of the first exhaust pipe 1, and a damage may occur. Accordingly, it is desirable to adjust the orientation of the cover member 2 upon inserting the cover member 2 into the first opening 11 so that a region around the long diameter portion 2A of the cover member 2 cover a region where the flow of the exhaust gas concentrates.

In contrast, according to the above-described embodiment, by using the positioning member 63 to arrange the cover member 2 at an appropriate position on the mounting surface 62, and adjusting a relative position between the pressing jig 6 and the first exhaust pipe 1 in the insertion process, it is possible to reliably arrange the cover member 2 at the insertion position. This can bring a region of the inner circumferential portion 21 around the long diameter portion 2A into contact with the chamfered portion 14C, or arrange that region at the weak region of the inner circumferential surface 15 of the first exhaust pipe 1, upon inserting the cover member 2 into the first opening 11.

(3) Further, in the above-described embodiment, and the modified examples 1 and 3 to 6, the specific portions 64A are located around at least three imaginary intersections 64B. Thus, arranging the cover member 2 to surround the positioning member 63 makes it easier for the cover member 2 to be arranged along the first imaginary line 64. Therefore, positioning of the cover member 2 can be appropriately performed.

(4) Moreover, in the above-described embodiment, and the modified examples 1 to 3, the positioning member 63 includes the two long portions 63A and the two short portions 63B. This makes it easier to grasp an appropriate attachment position of the cover member 2 based on the positioning member 63. Also, by arranging the cover member 2 to surround the positioning member 63, it is possible to more reliably arrange the cover member 2 along the first imaginary line 64. Therefore, positioning of the cover member 2 can be appropriately performed.

7. Other Embodiments (1) The groove 13 does not have to be formed at the first end 10 of the first exhaust pipe 1 in the above-described embodiment. Further, the groove 13 and the first rim 14 do not have to be formed at the first end 10, and the first and second ends 10, 30 may be formed as flat planes with no step. Even in a case as such, similar to the above-described embodiment, the cover member 2 can be attached to the first end 10, and the held portion 20 of the cover member 2 can be held by the first and second ends 10, 30.

(2) In the above-described embodiment, the cover member 2 is attached to the first opening 11 at the first end 10 on the upstream side of the first exhaust pipe 1. The first exhaust pipe 1 is connected to the downstream side of the second exhaust pipe 3 that discharges the exhaust gas from the turbocharger. However, other than the above, the cover member 2 may be attached to an opening at an end of the downstream side of the first exhaust pipe 1, or may be attached similarly to an exhaust pipe installed away from the turbocharger or to an exhaust pipe that forms an exhaust gas flow path that is not provided with a turbocharger.

Moreover, the cover member 2 may be attached similarly to an opening of a tubular member installed in a vehicle, or an exhaust pipe that is not installed in a vehicle or an opening of a tubular member other than exhaust pipe. In addition, the cover member 2 may be attached similarly to an opening of an opening member, other than a tubular member, the opening member having an internal space, and the opening that communicates with the internal space and an end surrounding the opening on its outer surface.

(3) Two or more functions achieved by one element of the above-described embodiments may be achieved by two or more elements. One function achieved by one element may be achieved by two or more elements. Two or more functions achieved by two or more elements may be achieved by one element. One function achieved by two or more elements may be achieved by one element. Part of the configurations in the above-described embodiments may be omitted. At least part of the configurations in one of the above-described embodiments may be added to or replaced with the configuration in another one of the above-described embodiments.

8. Technical Idea Disclosed in Present Specification

Clause 1

A method of manufacturing an opening member with an approximately circular opening at its end, comprising:

attaching a cover member to a mounting surface of a jig; and inserting the cover member attached to the mounting surface of the jig into the opening, the cover member comprising:

an inner circumferential portion that is an approximately elliptical ring-shaped portion wherein, when the cover member is inserted into the opening, an outer circumferential surface of the inner circumferential portion faces an inner circumferential surface surrounding an internal space of the opening member, the internal space communicating with the opening; and a held portion that extends outward from an end of the inner circumferential portion, and is held between the end of the opening member and a miscellaneous member to be connected to the opening, a long diameter of an outer circumference of the inner circumferential portion being equal to, or longer than, a diameter of the opening, a short diameter of the outer circumference of the inner circumferential portion being shorter than the diameter of the opening, a length of the outer circumference of the inner circumferential portion being shorter than or equal to a circumference length of the opening, first and second imaginary lines being settable on the mounting surface, the first imaginary line indicating the inner circumferential portion of the cover member attached to the mounting surface, the second imaginary line indicating the opening upon insertion of the cover member attached to the mounting surface, a center of the inner circumferential portion indicated by the first imaginary line being approximately coincident with a center of the opening indicated by the second imaginary line, a positioning member being provided inside the first and second imaginary lines on the mounting surface, the positioning member being adjacent to a plurality of specific portions on the first imaginary line, and at least two of the plurality of specific portions facing each other across the center of the first imaginary line and the center of the second imaginary line.

Clause 2

The method of manufacturing an opening member according to Clause 1, wherein the plurality of specific portions are located around at least three intersections of the first imaginary line and the second imaginary line.

Clause 3

The method of manufacturing an opening member according to Clause 1 or 2, wherein the positioning member includes two long portions extending along a direction of the long diameter of the inner circumferential portion, and two short portions extending along a direction of the short diameter, the inner circumferential portion having an approximately elliptical shape indicated by the first imaginary line.

Clause 4

The method of manufacturing an opening member according to any one of Clauses 1 to 3, wherein the opening member is an exhaust pipe to be installed in a vehicle.

What is claimed is:

1. A method of manufacturing an opening member with a circular opening at an end of the opening member, the method comprising:

attaching a cover member to a mounting surface of a pressing jig; and inserting the cover member attached to the mounting surface of the pressing jig into the opening, the cover member comprising:

an inner circumferential portion that is an elliptical ring-shaped portion wherein, when the cover member is inserted into the opening, an outer circumferential surface of the inner circumferential portion faces an inner circumferential surface surrounding an internal space of the opening member, the internal space communicating with the opening; and a held portion that extends outward from an end of the inner circumferential portion, and is held between the end of the opening member and a miscellaneous member to be connected to the opening, wherein a long diameter of an outer circumference of the inner circumferential portion is equal to, or longer than, a diameter of the opening, a short diameter of the outer circumference of the inner circumferential portion is shorter than the diameter of the opening, a length of the outer circumference of the inner circumferential portion is shorter than or equal to a circumference length of the opening, first and second imaginary lines is settable on the mounting surface, the first imaginary line indicating the inner circumferential portion of the cover member attached to the mounting surface, the second imaginary line indicating the opening upon insertion of the cover member attached to the mounting surface, a center of the inner circumferential portion indicated by the first imaginary line being coincident with a center of the opening indicated by the second imaginary line, and a positioning member is provided inside the first and second imaginary lines on the mounting surface, the positioning member being adjacent to a plurality of specific portions on the first imaginary line, and at least two of the plurality of specific portions facing each other across the center of the first imaginary line and the center of the second imaginary line.

2. The method of manufacturing the opening member according to claim 1, wherein the plurality of specific portions are located around at least three intersections of the first imaginary line and the second imaginary line.

3. The method of manufacturing the opening member according to claim 2, wherein the plurality of specific portions are located around four intersections of the first imaginary line and the second imaginary line.

4. The method of manufacturing the opening member according to claim 1, wherein the positioning member protrudes from the mounting surface of the pressing jig.

5. The method of manufacturing the opening member according to claim 4, wherein the positioning member includes a plurality of round portions, and each of the plurality of round portions extends along a rounded part at a rim of a region where the positioning member is provided on the mounting surface of the pressing jig, and each of the plurality of round portions is adjacent to one of the plurality of specific portions.

6. The method of manufacturing the opening member according to claim 1, wherein the positioning member includes at least one long portion extending along a direction of the long diameter of the inner circumferential portion, and at least one short portion extending along a direction of the short diameter of the inner circumferential portion, the inner circumferential portion having an elliptical shape indicated by the first imaginary line.

7. The method of manufacturing the opening member according to claim 6, wherein the at least one long portion includes two long portions, and the at least one short portion include two short portions.

8. The method of manufacturing the opening member according to claim 1, wherein the cover member is attached to the mounting surface of the pressing jig by magnetic force.

9. The method of manufacturing the opening member according to claim 1, wherein the opening member is an exhaust pipe to be installed in a vehicle.

10. The pressing jig used in the method of manufacturing the opening member according to claim 1, the pressing jig comprising:

the mounting surface configured to have the cover member attached thereto; and the positioning member provided inside the first and second imaginary lines on the mounting surface, the first and second imaginary lines being settable on the mounting surface, the first imaginary line indicating the inner circumferential portion of the cover member attached to the mounting surface, the second imaginary line indicating the opening upon insertion of the cover member attached to the mounting surface, the center of the inner circumferential portion indicated by the first imaginary line being coincident with the center of the opening indicated by the second imaginary line, the positioning member being adjacent to a the plurality of specific portions on the first imaginary line, and the at least two of the plurality of specific portions facing each other across the center of the first imaginary line and the center of the second imaginary line.

11. The pressing jig according to claim 10, wherein:

the positioning member protrudes from the mounting surface of the pressing jig.

* * * * *